US005894732A

United States Patent [19]

Kwan

[11] Patent Number: 5,894,732

[45] Date of Patent: Apr. 20, 1999

[54] HEAT SHIELD ARRANGEMENT FOR A GAS TURBINE COMBUSTION CHAMBER

[75] Inventor: William Kwan, Berlin, Germany

[73] Assignee: BMW Rolls-Royce GmbH, Oberursel, Germany

[21] Appl. No.: 08/913,122

[22] PCT Filed: Mar. 1, 1996

[86] PCT No.: PCT/EP96/00860

§ 371 Date: Sep. 8, 1997

§ 102(e) Date: Sep. 8, 1997

[87] PCT Pub. No.: WO96/27765

PCT Pub. Date: Sep. 12, 1996

[30] Foreign Application Priority Data

Mar. 8, 1995 [DE] Germany ..... 195 08 111

[51] Int. Cl.[6] ..... F02G 3/00

[52] U.S. Cl. ..... 60/756; 60/748; 60/752

[58] Field of Search ..... 60/740, 748, 39.37, 60/752, 756

[56] References Cited

U.S. PATENT DOCUMENTS

| | | | |
|---|---|---|---|
| 4,322,945 | 4/1982 | Peterson et al. | 60/740 |
| 4,934,145 | 6/1990 | Zeisser . | |
| 5,509,270 | 4/1996 | Pearce et al. | 60/740 |
| 5,623,827 | 4/1997 | Monty | 60/748 |

FOREIGN PATENT DOCUMENTS

| | | |
|---|---|---|
| 0 153 842 | 9/1985 | European Pat. Off. . |
| 0 521 687 | 1/1993 | European Pat. Off. . |
| 2 637 675 | 4/1990 | France . |
| 1 594 463 | 7/1981 | United Kingdom . |
| 2 252 152 | 7/1992 | United Kingdom . |

*Primary Examiner*—Charles G. Freay
*Attorney, Agent, or Firm*—Evenson, McKeows Edwards & Lenahan, P.L.L.C.

[57] ABSTRACT

In order to cool the hot surface of the heat shield that surrounds the burner of a gas turbine annular combustion chamber as efficiently as possible, especially in the vicinity of the burner throughflow opening, a cooling air stream that escapes through a ridge that runs around the edge of the throughflow opening is guided by a guide rib in the direction of the throughflow opening. This guide rib is aligned essentially parallel to the ridge and on the combustion chamber side has an end that is bent in such fashion that the cooling air stream that flows into the gap between the ridge and the guide rib is deflected thereby in the direction of the hot surface of the heat shield.

10 Claims, 5 Drawing Sheets

HEAT SHIELD ARRANGEMENT FOR A GAS TURBINE COMBUSTION CHAMBER

BACKGROUND AND SUMMARY OF THE INVENTION

The invention relates to a heat shield arrangement for a gas turbine combustion chamber with a heat shield having a central throughflow opening for a burner as well as a ridge extending circumferentially at the edge of the throughflow opening. The ridge has a plurality of air blow-by openings for the cool air that is guided to the cold back side of the heat shield facing away from the combustion chamber. Reference is made regarding prior art for example to European Patent document EP 0 471 437 A1 wherein, similarly to this known prior art, the present heat shield is also provided preferably for an annular combustion chamber.

The hot surface of the heat shield must be cooled intensively, for which purpose conventional heat shields have a plurality of cooling air throughput openings through which the cooling air stream directed at the cold back side of the heat shield can pass through the heat shield and thus strike the hot surface of the heat shield, producing a film of cooling air. However, it is not possible under these conditions to sufficiently cool the annular area around the burner throughflow opening, which is subjected to particularly high temperature stress. In addition, the cooling air stream that escapes in the vicinity of the throughflow opening through the gap between a sealing part that receives the burner as well as the heat shield is insufficient for this purpose.

The goal of the invention therefore is to provide measures with whose aid the cooling of the heat shield can be further improved, especially in the vicinity of the burner throughflow opening.

The solution to this problem is characterized by a guide rib provided inside the throughflow opening and aligned essentially parallel to the ridge. The end of the guide rib on the combustion chamber side is bent at an angle in order to deflect the cooling air stream flowing in through the air blow-by openings into the gap between the ridge and the guide rib in the direction of the hot surface of the heat shield. Advantageous embodiments and improvements are described herein.

The invention is described in greater detail with reference to preferred embodiments.

DETAILED DESCRIPTION OF THE DRAWINGS

Figure 1:
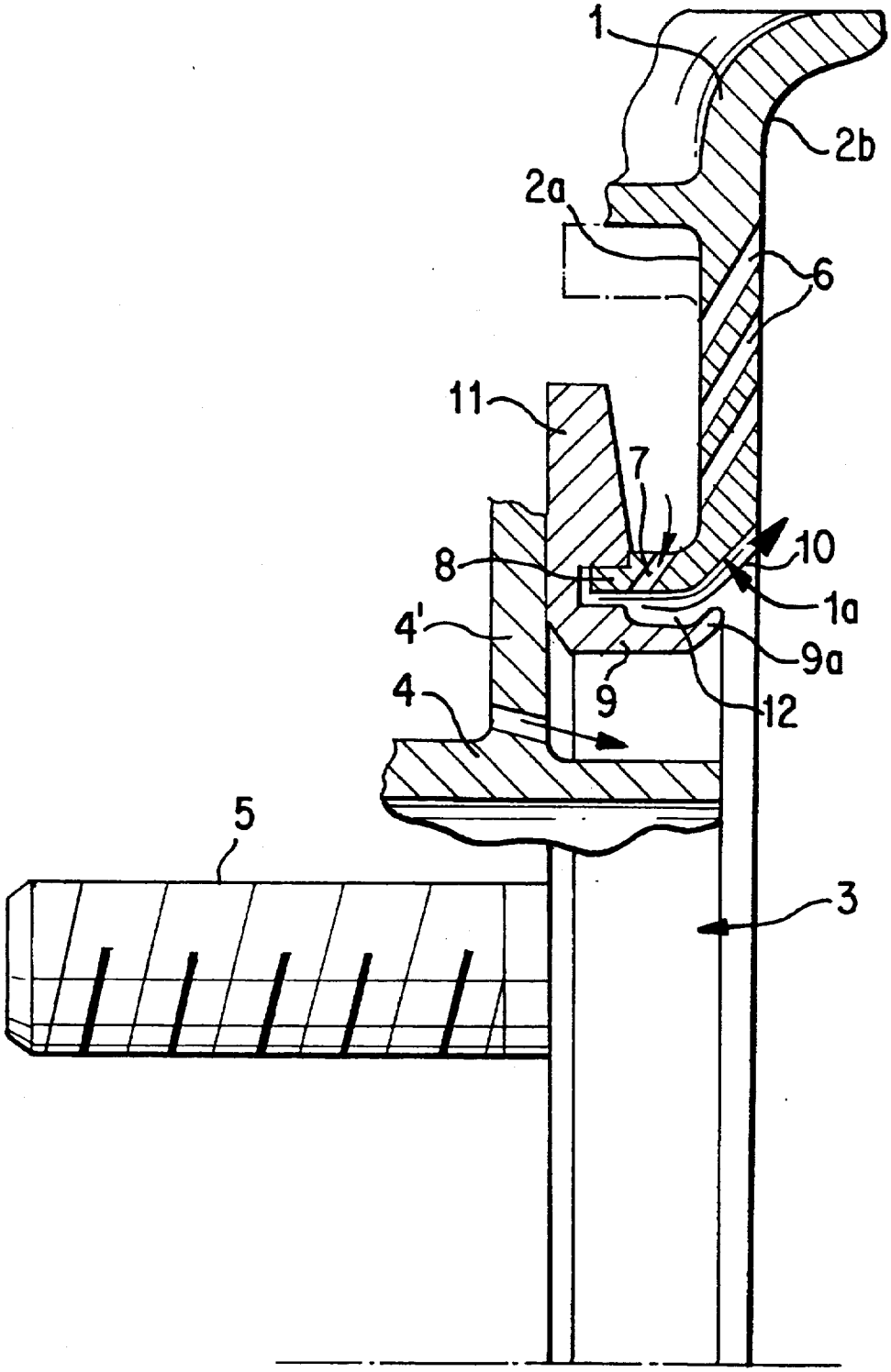
FIG. 1 is a schematic half section through a heat shield arrangement according to the invention.

Referring to the figures, the cold back side of heat shield 1 is marked by reference number 2*a*, while the hot surface of the heat shield that faces the combustion chamber (not shown) has reference number 2*b*. This heat shield 1 as usual surrounds a burner, not shown, through which a fuel-air flow is introduced into the combustion chamber of the gas turbine. For this purpose, the heat shield has a throughflow opening 3 for the burner. Likewise in usual fashion, the burner is surrounded by a sealing part 4. In addition, FIG. 1 shows a bolt 5 projecting from heat shield 1 behind throughflow opening 3. The bolt serves to fasten heat shield 1 to the combustion chamber head of the gas turbine.

Hot surface 2*b* of the heat shield must be cooled intensively. For this purpose, a cooling air stream is guided to the cold back side 2*a* of heat shield 1. The cooling air stream (as shown in FIG. 1) penetrates at least partially through a plurality of bores 6 in heat shield 1 and, since these bores 6 run at an angle to surface 2*b*, is applied as a cooling air film to the hot surface 2*b* of heat shield 1. Similarly, a plurality of air blow-by openings 7 is provided in a ridge 8 provided on the edge of throughflow opening 3, especially in the area of the back side 2*a* of the heat shield 1. Cooling air can then pass from back side 2*a* to the area of throughflow opening 3 through these air blow-by openings 7. In the embodiments shown in FIGS. 1 and 4, ridge 8 is part of heat shield 1 while in the other embodiments ridge 8 is part of a separate annular element 11.

In order to cool intensively, in particular the marginal area of heat shield 1 in the vicinity of throughflow opening 3 using this cooling air that passes through air blow-by openings 7 in ridge 8, a guide rib 9 aligned essentially parallel to ridge 8 is provided. An end 9*a* of said guide rib is bent on the combustion chamber side so that the cooling air stream, as indicated by arrow 10, is deflected in the direction of the hot surface 2*b* of heat shield 1. As a result, there is an annular gap 12 between ridge 8 and guide rib 9, through which gap the cooling air stream passing through air blow-by openings 7 is guided and finally deflected along the bent free end 9*a* of guide rib 9 in the direction of the hot surface 2*b* of heat shield 1. Preferably, free end 9*a* of guide rib 9 is aligned essentially parallel to beveled edge 1*a* of heat shield 1 in the corner area of throughflow opening 3 and hot surface 2*b* (see FIG. 1).

In the embodiment shown in FIG. 1, guide rib 9 is made in the form of a so-called annular element 11 located between a collar 4' of sealing part 4 and ridge 8 provided on heat shield 1. This annular element 11 is both simple to manufacture and readily mounted on the likewise easily manufactured heat shield 1.

Figure 2:
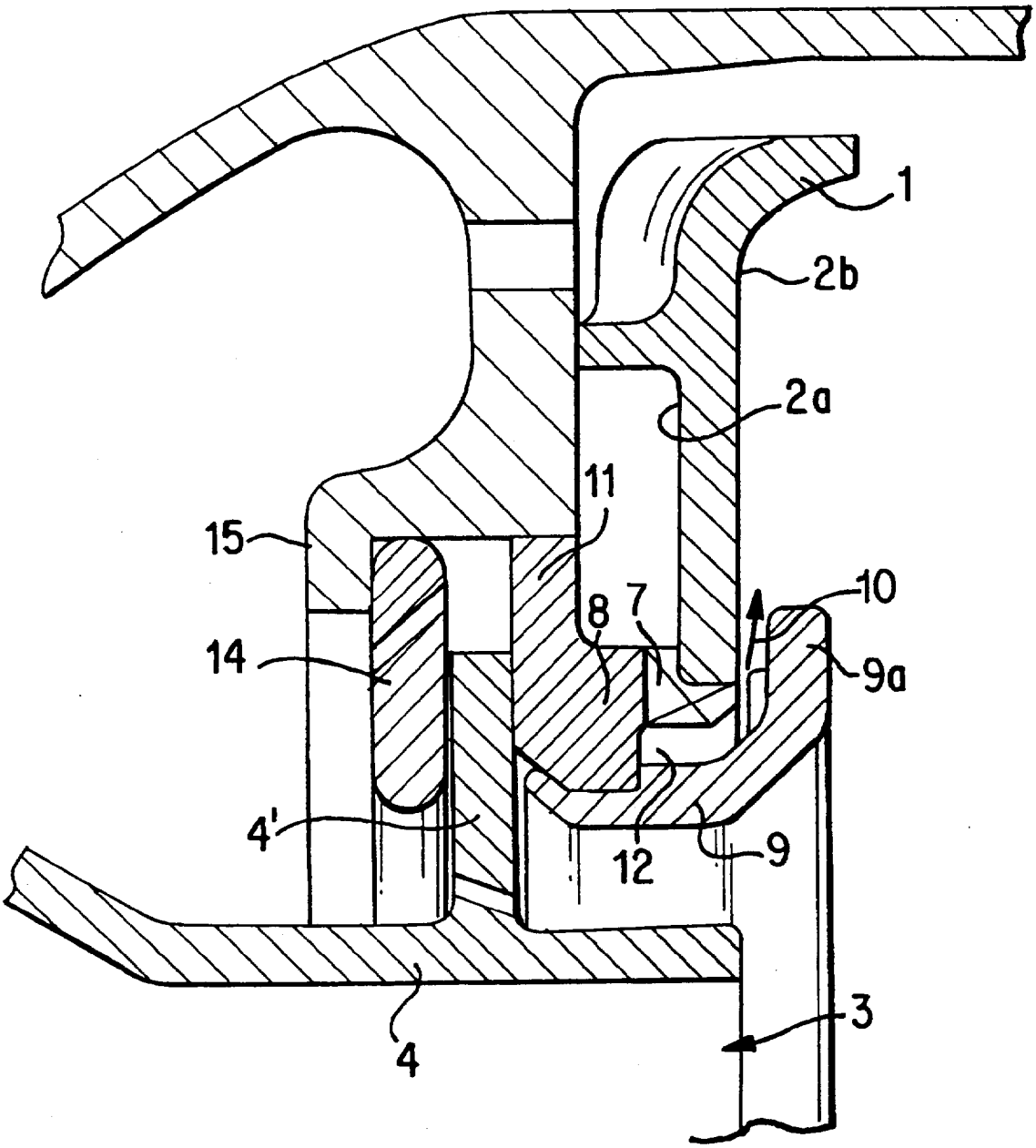
FIG. 2 is a schematic half section through a heat shield arrangement according to the invention.
Figure 3:
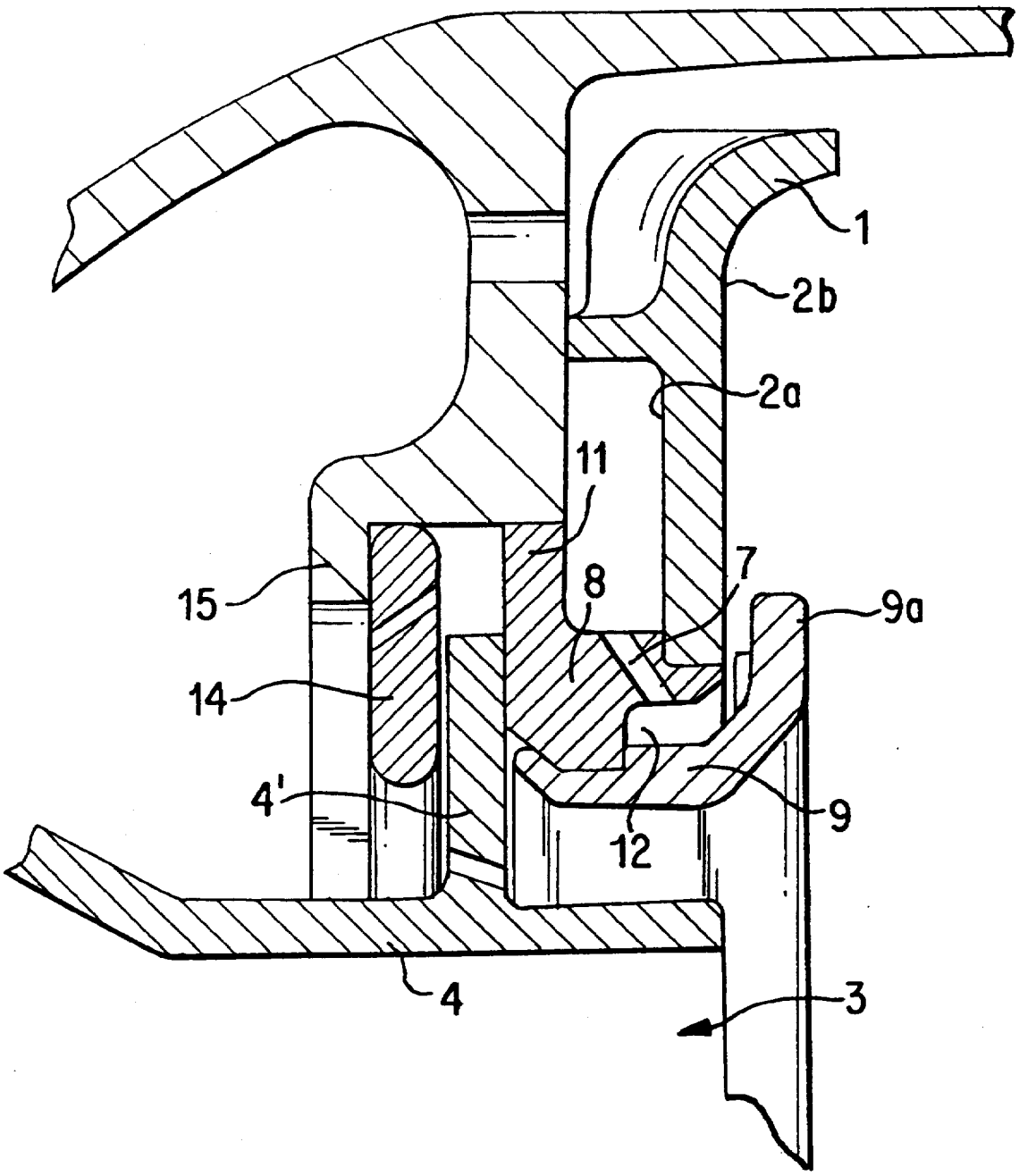
FIG. 3 is a schematic half section through a heat shield arrangement according to the invention.

In the embodiment according to FIG. 2, an annular element 11 is likewise provided between collar 4' and heat shield 1, said element 11 in this case forming ridge 8 and having air blow-by openings 7. Guide rib 9, which constitutes a separate, similarly annular component, abuts this annular element 11. The air blow-by openings 7 in annular element 11 are provided with vorticization devices so that the cooling air that passes through air blow-by openings 7 can be subjected to a desired vorticization. A similar embodiment with air blow-by openings 7 without vorticization means is shown in FIG. 3.

Figure 4:
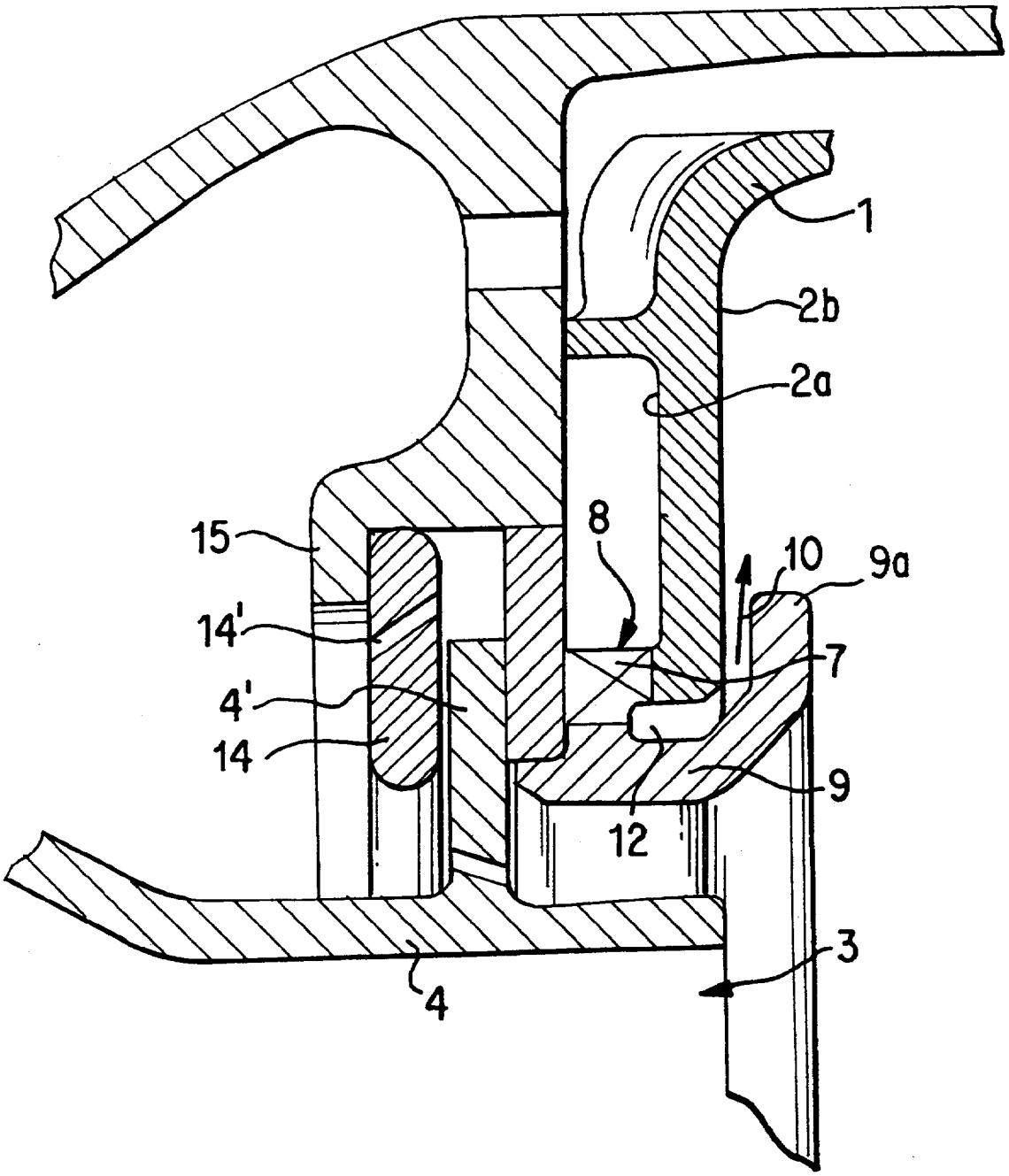
FIG. 4 is a schematic half section through a heat shield arrangement according to the invention.

In the embodiment according to FIG. 4, not only ridge 8 but also guide rib 9 are themselves parts of heat shield 1. Guide rib 9 is shaped on heat shield 1. In particular, heat shield 1 together with shaped guide rib 9 constitutes a cast part. In this embodiment according to FIG. 4, just as in the embodiments already described in connection with FIGS. 2 and 3, the free end 9*a* of guide rib 9 extends into the combustion chamber of the gas turbine for a distance such that this free end 9*a* itself is directed parallel to hot surface 2*b* of heat shield 1. In this manner, the cooling air stream that penetrates annular gap 12 is guided especially reliably and precisely against heat shield surface 2*b*. Otherwise, in this embodiment according to FIG. 4, the air blow-by holes 7 are also provided with vorticization devices, represented by the cross grid shown in the figure.

Figure 5A:
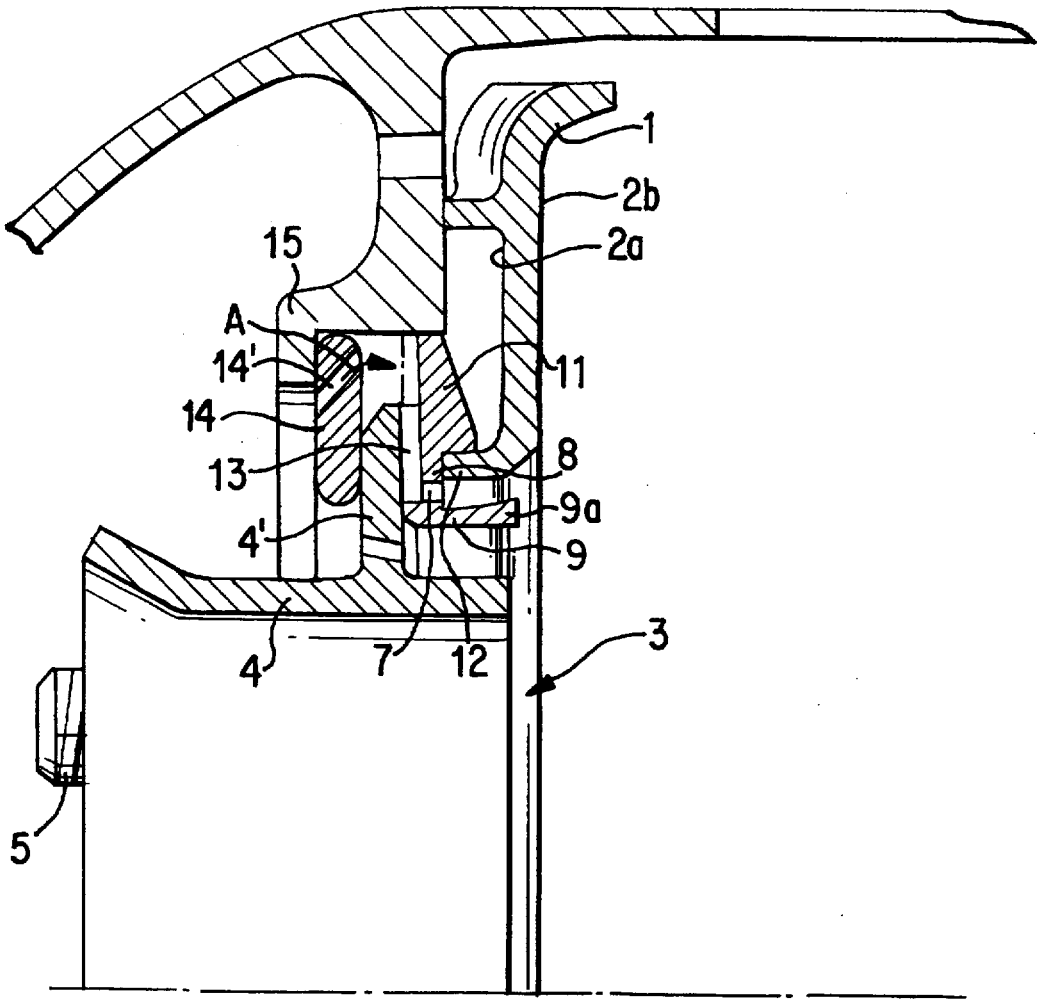
FIG. 5*a* is a schematic half-section of another embodiment according to the invention.
Figure 5B:
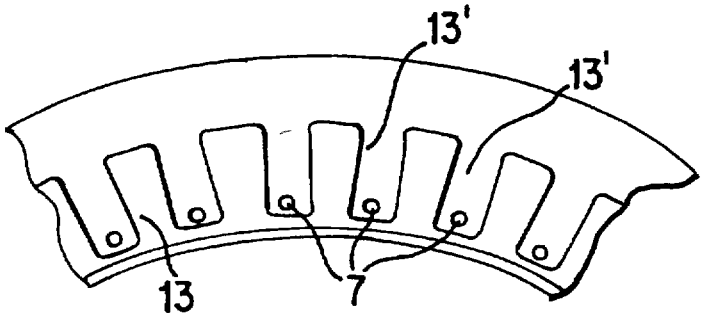
FIG. 5*b* is partial section view taken in the direction of arrow A in FIG. 5*a*.

FIGS. 5*a* and 5*b* show another embodiment in which guide rib 9 is shaped on annular element 11 similarly to the embodiment in FIG. 1. In this embodiment however the air blow-by openings 7 are in annular element 11, so that further measures are necessary to permit air to access these air blow-by openings 7. Therefore a ring 13, slotted in a gear-like manner, is provided between annular element 11 and collar 4' of sealing part 4, the toothed slots 13' of the ring 13 permitting air to access air blow-by openings 7. Not only in this embodiment but in the previous ones as well, a spacer 14 provided with air blow-by openings 14' is also shown, by which the sealing part 4 with its collar 4' abuts end wall 15' of the combustion chamber. The cooling air stream supplied passes through air blow-by openings 14' to the side of ridge 8 that faces away from the combustion chamber, in other words the cooling air stream must first pass through air blow-by openings 14' in order to then be able to flow through air blow-by openings 7 into annular gap 12 between ridge 8 and guide rib 9 and then eventually be deflected by this guide rib 9 in the direction of hot surface 2*b* of heat shield 1.

I claim:

1. A gas turbine combustion chamber having a heat shield with a central through-flow opening for a burner and a ridge running around an edge of the central through-flow opening, comprising:

a plurality of air blow-by openings arranged in said ridge for cool air guided against a cold back side of the heat shield which faces away from the combustion chamber;

a guide rib located inside said through-flow opening and aligned essentially in parallel to said ridge, a combustion-chamber-side end of said guide rib being bent at an angle in order to deflect the cool air entering through said plurality of air blow-by openings into a gap formed between said ridge and said guide rib in a direction of a hot surface of said heat shield;

a sealing part collar arranged to surround the burner as well as the heat shield;

wherein said guide rib has a position between said sealing part collar and said heat shied.

2. The gas turbine combustion chamber according to claim 1, further comprising an annular element arranged between said sealing part collar and said heat shield, wherein said guide rib abuts said annular element.

3. The gas turbine combustion chamber according to claim 2, further comprising a ring having a plurality of slots having a gear-like shape, said ring being located between the annular element and the sealing part collar, said plurality of slots permitting air to enter the plurality of air blow-by openings.

4. The gas turbine combustion chamber according to claim 1, wherein said plurality of air blow-by openings include vorticization devices.

5. The gas turbine combustion chamber according to claim 2, wherein said plurality of air blow-by openings include vorticization devices.

6. The gas turbine combustion chamber according to claim 3, wherein said plurality of air blow-by openings include vorticization devices.

7. A gas turbine combustion chamber having a heat shield with a central through-flow opening for a burner and a ridge running around an edge of the central through-flow opening, comprising:

a plurality of air blow-by openings arranged in said ridge for cool air guided against a cold back side of the heat shield which faces away from the combustion chamber;

a guide rib located inside said through-flow opening and aligned essentially in parallel to said ridge, a combustion-chamber-side end of said guide rib being bent at an angle in order to deflect the cool air entering through said plurality of air blow-by openings into a gap formed between said ridge and said guide rib in a direction of a hot surface of said heat shield;

wherein said guide rib is formed on said heat shield.

8. The gas turbine combustion chamber according to claim 7, wherein said heat shield and said guide rib are a single cast part.

9. The gas turbine combustion chamber according to claim 7, wherein said plurality of air blow-by openings include vorticization devices.

10. The gas turbine combustion chamber according to claim 8, wherein said plurality of air blow-by openings include vorticization devices.

* * * * *